US009117612B2

(12) United States Patent
Feil et al.

(10) Patent No.: US 9,117,612 B2
(45) Date of Patent: Aug. 25, 2015

(54) TRIGGERING UNIT FOR ACTUATING A MECHANICAL SWITCHING UNIT OF A DEVICE

(71) Applicant: Siemens Aktiengesellschaft, Munich (DE)

(72) Inventors: Wolfgang Feil, Schwandorf (DE); Martin Maier, Erbendorf (DE); Klaus Pfitzner, Amberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/363,479

(22) PCT Filed: Nov. 20, 2012

(86) PCT No.: PCT/EP2012/073052

§ 371 (c)(1),
(2) Date: Jun. 6, 2014

(87) PCT Pub. No.: WO2013/092067

PCT Pub. Date: Jun. 27, 2013

(65) Prior Publication Data

US 2014/0321023 A1 Oct. 30, 2014

(30) Foreign Application Priority Data

Dec. 20, 2011 (DE) ..... 10 2011 089 251

(51) Int. Cl.
*H01H 9/00* (2006.01)
*H01H 61/01* (2006.01)
(Continued)

(52) U.S. Cl.
CPC ..... *H01H 61/01* (2013.01); *H01H 47/22* (2013.01); *H01H 51/00* (2013.01); *H01H 51/06* (2013.01);
(Continued)

(58) Field of Classification Search
USPC ..... 361/194
See application file for complete search history.

(56) References Cited

U.S. PATENT DOCUMENTS 4,535,312 A * 8/1985 Lomax ..... 335/196
4,812,690 A * 3/1989 Eilertsen ..... 310/27
(Continued)

FOREIGN PATENT DOCUMENTS

DE 9421240 U1 8/1995
DE 69115042 T2 7/1996
(Continued)

OTHER PUBLICATIONS

International Search Report PCT/ISA/210 for International Application No. PCT/EP2012/073052 Dated Feb. 26, 2013.
(Continued)

*Primary Examiner* — Ronald W Leja
(74) *Attorney, Agent, or Firm* — Harness, Dickey & Pierce, P.L.C.

(57) ABSTRACT

A triggering unit includes a tappet having a moving bearing, a power accumulator, a holding device and a printed circuit board coil. In the normal state the power accumulator acts upon the tappet with a power accumulator force in the direction of the first stop position and the holding device holds the tappet with a holding force in the second stop position. A printed circuit board coil force can be generated by an activation of the printed circuit board coil. The power accumulator, the holding device and the printed circuit board coil are formed such that the tappet rests in the second stop position in the inactive state of the printed circuit board coil and through an activation of the printed circuit board coil, the tappet assumes the first stop position such that the triggered status is given.

19 Claims, 2 Drawing Sheets

(51) Int. Cl.

| | |
|---|---|
| ***H01H 51/06*** | (2006.01) |
| ***H01H 71/32*** | (2006.01) |
| ***H01H 47/22*** | (2006.01) |
| ***H01H 51/00*** | (2006.01) |
| *H01H 71/24* | (2006.01) |
| *H01H 71/28* | (2006.01) |
| *H01F 7/06* | (2006.01) |

(52) U.S. Cl.
CPC ..... *H01H 71/2481* (2013.01); *H01H 71/322* (2013.01); *H01F 2007/068* (2013.01); *H01H 71/2454* (2013.01); *H01H 71/28* (2013.01)

(56) References Cited

U.S. PATENT DOCUMENTS

| | | | | |
|---|---|---|---|---|
| 5,387,892 | A * | 2/1995 | Rossetti et al. | 335/254 |
| 5,673,012 | A * | 9/1997 | Stadler et al. | 335/78 |
| 6,266,867 | B1 * | 7/2001 | Kern | 29/602.1 |
| 7,973,635 | B2 | 7/2011 | Baarman et al. | |
| 2005/0066737 | A1 * | 3/2005 | Crowson, II | 73/668 |
| 2005/0168308 | A1 * | 8/2005 | Ward | 335/229 |
| 2011/0193661 | A1 | 8/2011 | Baks et al. | |
| 2012/0113557 | A1 | 5/2012 | Hengelein et al. | |
| 2012/0188033 | A1 | 7/2012 | Baks et al. | |
| 2014/0321023 | A1 * | 10/2014 | Feil et al. | 361/194 |

FOREIGN PATENT DOCUMENTS

| | | | |
|---|---|---|---|
| DE | 19646243 | C1 | 10/1997 |
| DE | 202008016518 | U1 | 2/2009 |
| DE | 102010012801 | A1 | 9/2011 |
| WO | WO-2010145756 | A1 | 12/2010 |

OTHER PUBLICATIONS

International Preliminary Report on Patentability for International Application No. PCT/EP2012/073052 dated Oct. 18, 2013.
German Office Action dated Oct. 2, 2012.

* cited by examiner

TRIGGERING UNIT FOR ACTUATING A MECHANICAL SWITCHING UNIT OF A DEVICE

PRIORITY STATEMENT

This application is the national phase under 35 U.S.C. §371 of PCT International Application No. PCT/EP2012/073052 which has an International filing date of Nov. 20, 2012, which designated the United States of America, and which claims priority to German patent application number DE 102011089251.6 filed Dec. 20, 2011, the entire contents of each of which are hereby incorporated herein by reference.

FIELD

At least one embodiment of the invention generally relates to a triggering unit for actuating a mechanical switching unit of a device for interrupting a supply phase of an energy-consuming load. A device of this type for interrupting a supply phase of a load is in particular a thermal overload relay by which protection for a motor or circuit is realized.

For this purpose, the corresponding supply phase of the motor or circuit that is to be monitored is routed by way of the device and monitored for thermal overload by means of a monitoring device. If a thermal overload is detected at the motor or in the circuit by the monitoring device, a mechanical switching unit is actuated by the monitoring device so that the supply phase routed by way of the device will be interrupted by way of the mechanical switching unit. An electrically conductive connection between an input terminal and an output terminal of the device can therefore be interrupted by way of the mechanical switching unit. In this case the electrically conductive connection between the input terminal and the output terminal of the device forms the supply phase that is to be monitored.

BACKGROUND

A mechanical switching unit is typically triggered by way of an actuating element, such that the supply phase (the phase routed by way of the device) is hereupon interrupted by the mechanical switching unit. In order to trigger the mechanical switching unit and therefore to interrupt the electrically conductive connection between the output terminal and input terminal of the device (monitored supply phase), a mechanical force is exerted on the actuating element of the mechanical switching unit. As a result of the actuation of the actuating element of the mechanical switching unit a supply phase routed by way of the device is finally interrupted.

In thermal overload relays a thermomechanical tripping device (bimetallic tripping device) is used as a monitoring device and triggering unit in most cases on account of the favourable cost level. In order to monitor the motor or circuit, the bimetallic tripping device is placed by way of the thermal overload relay in the supply phase that is to be monitored. Since the bimetallic tripping device is situated in the supply phase (in the main current path of the load), it is heated to varying degrees as a function of the current flow present. If a thermal overload is present at the load, the increased current flow in the supply phase causes the bimetallic tripping device, in particular the bimetal thereof, to be deformed in such a way that a mechanical force is exerted on the actuating element of the mechanical switching unit by the bimetallic tripping device, as a result of which said actuating element is triggered. The monitored supply phase is consequently interrupted by means of the mechanical switching unit.

Also known are overload relays having electromagnetic triggering units in which the mechanical switching unit can be triggered by way of an electromagnetic tripping device of the triggering unit. It is possible to make a distinction in this context between two types of triggering units. There are triggering units which receive the triggering energy for actuating the actuating element of the mechanical switching unit directly from the triggering electronics of the triggering unit, and triggering units which are constructed as electromechanically triggered energy accumulators (maglatch). The latter have the advantage that the triggering electronics must provide less triggering energy than is actually needed for actuating the actuating element of the mechanical switching unit.

Independently thereof, the electromagnetic triggering units typically include a coil wound on a coil former, wherein the coil terminals must additionally be connected by way of lines (coil connecting lines) and/or plug-in connections to the electronics of the triggering unit.

SUMMARY

At least one embodiment of the present invention provides an improved triggering unit for actuating a mechanical switching unit of a device for interrupting a supply phase of a load. In at least one embodiment, the triggering unit should be compact, inexpensive and energy-optimized so that it requires no electrical energy in the normal state and in the triggered state. In addition, in at least one embodiment it is intended that the mechanical switching unit should be capable of being triggered with an absolute minimum of electrical triggering energy.

At least one embodiment of a device includes a triggering unit for actuating a mechanical switching unit of a device for interrupting a supply phase of a load, wherein the triggering unit comprises a movably mounted plunger which can assume a first and a second stop position, an energy accumulator, in particular a spring, a holding device, in particular a permanent magnet, and a printed circuit board coil, wherein the triggering unit can assume a triggered state and a normal state, wherein the plunger is located in the first stop position in the triggered state and in the second stop position opposite the first stop position in the normal state, wherein the first energy accumulator applies an energy accumulator force (F1) to the plunger in the direction of the first stop position in the normal state and the holding device holds the plunger in the second stop position by means of a holding force (F2), wherein a printed circuit board coil force can be generated by activation of the printed circuit board coil, wherein the energy accumulator, the holding device and the printed circuit board coil are embodied in such a way that the plunger remains in the second stop position in the inactive state of the printed circuit board coil and the plunger assumes the first stop position due to the printed circuit board coil being activated, as a result of which the triggered state is present.

Advantageous developments of the invention are disclosed in the dependent claims.

BRIEF DESCRIPTION OF THE DRAWINGS

The invention and embodiments of the invention are described and explained in more detail below with reference to the example embodiments illustrated in the figures, in which.

DETAILED DESCRIPTION OF THE EXAMPLE EMBODIMENTS

Figure 1:
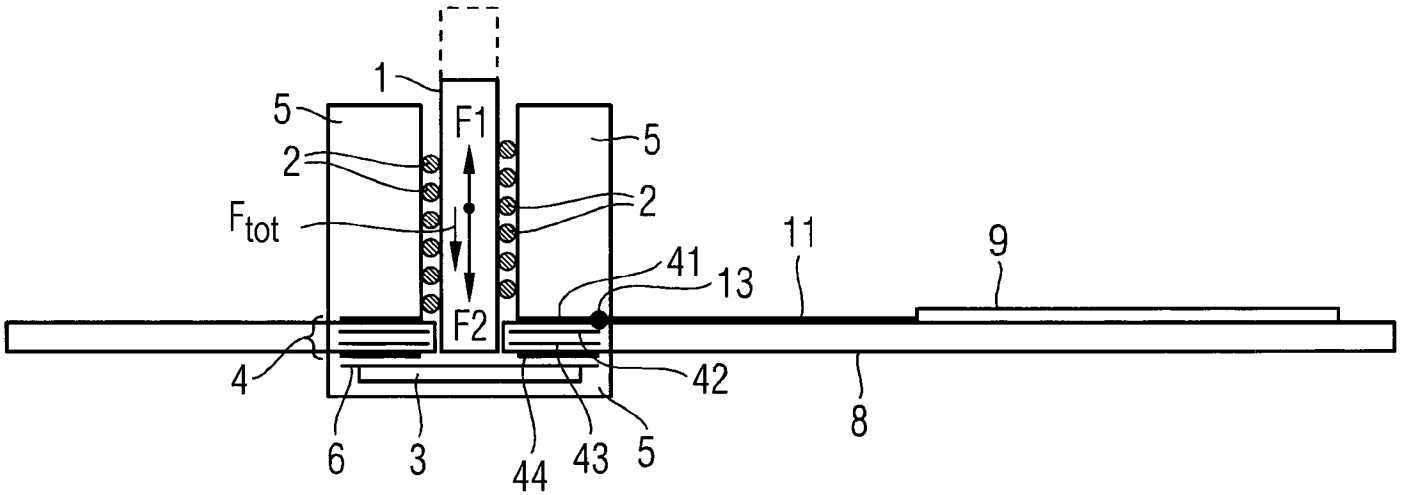
FIG. 1 shows a schematic representation of a triggering unit for actuating a mechanical switching unit of a device in the normal state.

At least one embodiment of a device includes a triggering unit for actuating a mechanical switching unit of a device for interrupting a supply phase of a load, wherein the triggering unit comprises a movably mounted plunger which can assume a first and a second stop position, an energy accumulator, in particular a spring, a holding device, in particular a permanent magnet, and a printed circuit board coil, wherein the triggering unit can assume a triggered state and a normal state, wherein the plunger is located in the first stop position in the triggered state and in the second stop position opposite the first stop position in the normal state, wherein the first energy accumulator applies an energy accumulator force (F1) to the plunger in the direction of the first stop position in the normal state and the holding device holds the plunger in the second stop position by means of a holding force (F2), wherein a printed circuit board coil force can be generated by activation of the printed circuit board coil, wherein the energy accumulator, the holding device and the printed circuit board coil are embodied in such a way that the plunger remains in the second stop position in the inactive state of the printed circuit board coil and the plunger assumes the first stop position due to the printed circuit board coil being activated, as a result of which the triggered state is present.

The device of at least one embodiment is preferably an overload relay. The supply phase of a load (e.g. electric motor) or a circuit can be monitored for thermal overload by means of an overload relay. If a thermal overload is detected by the device, the supply phase routed by way of the device is interrupted. For the purpose of detecting the thermal overload, the device comprises a monitoring device by way of which the load or the circuit can be monitored with regard to a thermal overload. The triggering unit comprises the plunger, the energy accumulator, the holding means and the printed circuit board coil. If an overload is detected by the monitoring device, the mechanical switching unit of the device is actuated by means of the triggering unit, thereby interrupting the monitored supply phase. The mechanical switching unit is triggered in particular by way of an actuating element of the mechanical switching unit. The actuating element is preferably actuated/triggered directly by means of the plunger.

In order to actuate the mechanical switching unit, a printed circuit board coil force is generated by way of the printed circuit board coil such that the plunger moves from the second stop position to the first stop position. By way of this change in position of the plunger a mechanical force is exerted onto the mechanical switching unit, in particular onto the latter's actuating element, with the result that the mechanical switching unit trips and the supply phase is interrupted.

Because the printed circuit board coil and preferably its supply lines are embodied by the printed circuit board there is in particular no requirement for the currently usual separate components: coil former, wound coil, coil connecting lines and plug-in connections. As a result thereof it is possible to realize an extremely compact design and achieve an improved cost level compared with today's exclusively thermomechanical solutions.

A further advantage resides in the fact that the actuation/triggering of the mechanical switching unit is possible by means of an electronic pulse. When the plunger is in the normal state, a total force Ftot acting on the plunger is present which acts in the direction of the second stop (the holding force is greater than the energy accumulator force). If the energy accumulator is a spring and the holding force a permanent magnet, the device can hold this position stable without additional electrical energy.

If a thermal overload is detected by the monitoring device, the printed circuit board coil is activated, i.e. current flows through it. A magnetic field is consequently formed by the printed circuit board coil. The magnetic field (printed circuit board coil force) of the printed circuit board coil can be used on the one hand in order to weaken the holding force of the holding means acting on the plunger. In the case of the permanent magnet the magnetic force (holding force) of the permanent magnet acting on the plunger is reduced by the magnetic field of the activated printed circuit board coil. In addition or alternatively, a force (magnetic force) can be exerted by the magnetic field of the printed circuit board coil on the plunger in the direction of the first stop position.

As a result of the activation of the printed circuit board, a printed circuit board coil force (force of the magnetic field of the printed circuit board coil) is therefore generated which changes the total force Ftot acting on the plunger in such a way that the total force Ftot acts in the direction of the first stop position of the plunger. The movably mounted plunger is consequently moved in the direction of the first stop position. If the holding device is a permanent magnet and the energy accumulator a spring, the force (F2) exerted on the plunger by the holding device decreases as the distance of the end of the plunger facing toward the holding device increases. Accordingly, the plunger automatically assumes the first stop position.

The printed circuit board coil force would therefore have to be applied only until such time as the energy accumulator force F1 acting on the plunger is greater than the holding force F2 acting on the plunger. The printed circuit board coil force must consequently be applied only until such time as the total force Ftot predominates in the direction of the first stop position. The printed circuit board coil force can, however, be maintained for a longer time in order to increase safety. In the triggered state (the plunger is located in the first stop position) the energy accumulator force (F1) is greater than the holding force (F2). The plunger is therefore in a self-holding state, which means that no printed circuit board coil force is necessary.

The mechanical switching unit is preferably placed within the device in such a way that the actuation of the mechanical switching unit is effected as a result of the first stop position being assumed by the plunger, such that an interruption to the supply phase is brought about by way of the mechanical switching unit.

A change in state for the plunger from the second stop position to the first stop position can therefore be brought about as a result of a brief activation of the printed circuit board coil by way of a current pulse. As the distance from the holding device increases, the total force Ftot acting on the plunger approaches the energy accumulator force (F1). Preferably the energy accumulator is embodied in such a way that the mechanical switching element is actuated solely by the energy accumulator force (F1) acting on the plunger. An energy-optimized device can be provided because no constant electrical energy supply is required for the triggering unit, since electrical energy in the form of a current pulse for the printed circuit board coil must preferably be provided solely for the triggering operation. The triggered state is preferably maintained by means of the energy accumulator force (F1) of the energy accumulator. The normal state is maintained by way of the holding force (F2) of the holding device.

In order to bring about the normal state from the triggered state a mechanical force must preferably be exerted on the plunger on the part of the customer so that the plunger assumes the second stop position. For this purpose the plunger is preferably pushed into the second stop position.

The plunger is preferably made of ferromagnetic material. The holding force F2 acting on the plunger is directed in particular in the direction of the second stop position of the plunger. The energy accumulator force F1 acting on the plunger is directed in particular in the direction of the first stop position of the plunger.

The first and the second stop position of the movably mounted plunger are preferably the respective end position of the plunger within the device in each case.

In an advantageous embodiment variant of the invention, the holding force acting on the plunger is greater in the normal state than the energy accumulator force acting on the plunger, such that the plunger remains in the second stop position. There is therefore no printed circuit board coil force present. The total force Ftot acting on the plunger is directed in the direction of the second stop of the plunger. The plunger is therefore held in the normal state solely by way of the holding force F2 of the holding device. If the holding device is embodied as a permanent magnet and the energy accumulator as a spring, no electrical energy source is necessary for holding the normal state.

In another advantageous embodiment variant of the invention, the energy accumulator force acting on the plunger is greater in the activated state than the holding force acting on the plunger, such that the plunger remains in the first stop position. No printed circuit board coil force is present. The total force Ftot acting on the plunger is directed in the direction of the first stop of the plunger. The plunger is therefore held in the triggered state solely by way of the energy accumulator force F1. If the holding device is embodied as a permanent magnet and the energy accumulator as a spring, no electrical energy source is necessary for holding the triggered state.

Only a current pulse at the printed circuit board coil is required in order to bring about the change of state from the normal state to the triggered state.

In a further advantageous embodiment variant of the invention, the printed circuit board coil is embodied as multilayer. A printed circuit board coil can be laminated on one side. If the printed circuit board coil is implemented in a multilayer embodiment, layers of the windings of the coil are arranged in different planes of the printed circuit board. If the printed circuit board coil is for example laminated on two sides or if layers of the windings of the coil are embodied within the printed circuit board, a multilayer printed circuit board coil is given.

In another advantageous embodiment variant of the invention, the printed circuit board coil is embodied within the printed circuit board. The layers of the windings of the printed circuit board coil are therefore arranged within the printed circuit board.

In a further advantageous embodiment variant of the invention, the printed circuit board of the printed circuit board coil comprises an evaluation unit for controlling the printed circuit board coil. The printed circuit board coil can be activated by way of the evaluation unit such that a current flows through the windings of the printed circuit board coil and a magnetic field (printed circuit board coil force) is generated. Preferably the magnitudes of the supply phase detected by means of the monitoring device are likewise evaluated by way of the evaluation unit.

Preferably, the connecting lines between the evaluation unit and the printed circuit board coil, in particular their termination points, are likewise embodied by the printed circuit board.

In another advantageous embodiment variant of the invention, if a thermal overload of the load supplied with energy by way of the device is detected, the evaluation unit activates the printed circuit board coil, thereby interrupting the supply phase to the load.

In a further advantageous embodiment variant of the invention, the plunger is enclosed by a pot made of ferromagnetic material. The plunger is enclosed by the pot in particular on its lateral surface and its side facing toward the holding device. The pot preferably encloses the lateral surface of the plunger by 80% in the normal state. The base of the pot is preferably arranged underneath the holding device such that the holding device is arranged between the end of the plunger facing toward the holding device and the base of the pot. Preferably the plunger projects slightly out of the pot in the normal state, though it can equally be completely enclosed by the pot.

In particular, the magnetic field of the printed circuit board coil force is strengthened by the pot made of ferromagnetic material. Furthermore, the magnetic field of the printed circuit board coil is steered in a targeted manner, such that in addition an improved electromagnetic compatibility is present.

It is advantageous in particular for the implementation of an electronically triggered mechanical switching device (maglatch) to encapsulate the triggering unit in a pot consisting of ferromagnetic material.

In another advantageous embodiment variant of the invention, the printed circuit board of the printed circuit board coil adjacent to the outermost winding of the printed circuit board coil has at least one aperture and the pot is mechanically connected to the printed circuit board by way of said at least one aperture. A printed circuit board coil connected to the rest of the printed circuit board by way of two to four ribs is a good compromise between as optimal a shielding as possible and the requirements in respect of mechanical stability. The ferromagnetic pot is inserted into the apertures, in particular slots, between the ribs and is thus mechanically well connected to the printed circuit board.

In a further advantageous embodiment variant of the invention, the at least one aperture frames at least 50% of the outermost winding of the printed circuit board coil. Preferably the printed circuit board coil is mechanically connected to the printed circuit board only by means of two or three ribs. The aperture is preferably embodied parallel to the outermost winding.

In another advantageous embodiment variant of the invention, the holding device is arranged on a side surface of the printed circuit board coil and a plate made of ferromagnetic material is arranged between the holding device and the printed circuit board coil. In particular the magnetic field of the printed circuit board coil can be embodied and guided in an improved manner by this. Preferably the plate made of ferromagnetic material covers, preferably completely, the side of the holding device facing toward the printed circuit board and/or the windings of the printed circuit board coil on the side directed toward the holding device.

In a further advantageous embodiment variant of the invention, a part of the lateral surface of the plunger is framed by the printed circuit board coil in the normal state. In the normal state the plunger preferably projects through the printed circuit board coil with its end aligned toward the holding device. In the triggered state of the plunger the end of the plunger facing toward the holding device preferably no longer projects into the printed circuit board coil.

In another advantageous embodiment variant of the invention, the plunger is guided by way of the side surface of the pot facing toward the plunger.

In a further advantageous embodiment variant of the invention, the energy accumulator is arranged between the pot and the plunger.

Preferably the energy accumulator is connected to the lateral surface of the plunger.

In another advantageous embodiment variant of the invention, the energy accumulator is a resilient element, in particular a spring, and/or the holding means is a magnet, in particular a permanent magnet.

In a further advantageous embodiment variant of the invention, a device, in particular a thermal overload relay, for interrupting a supply phase of a load comprises a mechanical switching unit and a triggering unit, wherein in the triggered state the triggering unit actuates the mechanical switching unit with the result that the device interrupts the supply phase of the load. The triggering unit serves to actuate the mechanical switching unit of the device. Upon actuation of the mechanical switching unit the supply phase routed by way of the device is interrupted by way of the mechanical switching unit of the device.

The device is in particular a thermal overload relay.

In another advantageous embodiment variant of the invention, a supply current path (phase) of a load can be routed through the device by way of an input-side and output-side terminal of the device, wherein in the normal state of the triggering unit the input-side terminal is electrically conductively connected to the output-side terminal and in the triggered state of the triggering unit the electrically conductive connection between the input-side terminal and the output-side terminal is interrupted. Due to the change of the plunger from the normal state to the triggered state the mechanical switching unit is actuated by way of the plunger. The supply current path is interrupted as a result of the actuation of the mechanical switching unit.

FIG. 1 shows a schematic representation of a triggering unit for actuating a mechanical switching unit of a device in the normal state. Shown in particular here is a side view of a section through the triggering unit. The triggering unit comprises a movably mounted plunger 1 made of ferromagnetic material, a pot 5 made of ferromagnetic material, a permanent magnet 3 as holding means 3, a spring 2 as energy accumulator 2, a plate 6 made of ferromagnetic material, a printed circuit board 8 comprising a printed circuit board coil 4, an evaluation unit 9 and a connecting line 11.

The printed circuit board coil 4 is connected to the evaluation unit 9 by way of the connecting line 11. The evaluation unit 9 can activate the printed circuit board coil 4 so that a magnetic field is generated by the printed circuit board coil 4. Current flows through the printed circuit board coil 4 in the activated state of the printed circuit board coil 4. In the non-activated state of the printed circuit board coil 4 no current flow is present through the printed circuit board coil 4.

The printed circuit board coil 4 is embodied as a multilayer (four-layer) coil. In other words, layers 41,42,43,44 of windings of the printed circuit board coil 4 are arranged in each case in different planes of the printed circuit board 8. The two external sides of the printed circuit board 8 each have a layer 41,44 of windings. In addition, two layers 42,43 of windings are arranged within the printed circuit board 8. The printed circuit board 8 is accordingly laminated on two sides and furthermore has two layers 42,43 of windings within the printed circuit board 8. Four layers 41,42,43,44 of windings are therefore present which form the printed circuit board coil 4. An extremely compact coil can be provided by way of a printed circuit board coil 4 of said type.

The individual windings of the layers 41,42,43,44 of the printed circuit board coil 4 are connected to one another. In order to connect the printed circuit board coil 4 to the evaluation unit 9, the layer 41,44 of windings applied on the external side of the printed circuit board in each case includes a termination point 13. Said termination point 13 is in particular the start of the outer winding of the respective layer 41,44. The inner winding of the layers 41,44 applied on the external side of the printed circuit board is connected in each case to the inner winding of the adjacent layer 42,43 of windings. The inner layers 42,43 of windings are in each case connected to one another by way of their outer winding.

The printed circuit board coil 4 is connected to the evaluation unit 9 by way of the connecting line 11. Owing to the printed circuit board coil 4 being integrated in the printed circuit board 8, a simplified connection of the printed circuit board coil 4 to the evaluation unit 9 can be realized. For this purpose the connecting line 11 is integrated into the printed circuit board 8 such that the printed circuit board coil 4, in particular the termination points 13 thereof, is connected in an electrically conductive manner to the evaluation unit 9 mounted on the printed circuit board. The printed circuit board coil 4 can therefore be activated by means of the evaluation unit 9. The termination point 13 of the layer 41 of windings applied on the top side of the printed circuit board 8 is depicted in FIG. 1.

The triggering unit serves for actuating the mechanical switching unit of the thermal overload relay. A supply phase routed by way of the thermal overload relay can be interrupted by way of an actuation of the mechanical switching unit. For this purpose a mechanical force must be exerted onto an actuating element of the mechanical switching unit. The mechanical force is exerted onto the actuating element by way of the plunger 1 of the triggering unit. For this purpose the plunger 1 must assume the first stop position (triggered state).

The plunger 1 is movably mounted within the triggering unit. In particular the plunger 1 can assume two positions: a first stop position (triggered state) and a second stop position (normal state). FIG. 1 shows the normal state of the plunger 1. The triggered state is indicated by the dashed line. The plunger 1 can be moved only in its lengthwise direction. A force is exerted onto the plunger 1 firstly by the spring 2 and by the permanent magnet 3. The spring 2, which encloses the plunger on its lateral surface, exerts a spring force F1 onto the plunger 1 in the direction of the first stop position. The spring 2 bears with one of its ends on the printed circuit board 8 and is mechanically operatively connected to the plunger 1 by the other of its ends. In the normal state the spring 2 is in the compressed state. The permanent magnet 3 is arranged on the underside of the printed circuit board 8 and holds the ferromagnetic plunger 1 in the second stop position. In the inactive state of the printed circuit board coil the total force Ftot acting on the plunger is directed in the direction of the second stop position, such that the plunger maintains the normal state. The holding force F2 of the permanent magnet 3 acting on the plunger 1 is therefore greater in the normal state of the plunger 1 than the spring force F1 of the spring 2 acting on the plunger 1.

The plunger 1 projects into the printed circuit board coil 4 with its end directed toward the permanent magnet 3. The plunger 1 can also project through the printed circuit board coil 4 with said end, i.e. the end of the plunger 1 (its front face) lies beneath the underside of the printed circuit board 8.

In order to intensify the printed circuit board coil force generated by the printed circuit board coil 4, the plunger 1 is encapsulated in a ferromagnetic pot 5. Said ferromagnetic pot 5 almost completely encloses the plunger 1 in its normal state over its lateral surface. Furthermore, the underside of the printed circuit board coil 4 is covered by the base of the pot 5. In this case the base of the pot 5 lies beneath the permanent magnet 3 such that it is situated between the plunger 1 and the base of the pot 5. A ferromagnetic plate 6 is also arranged between the permanent magnet 3 and the printed circuit board coil 4. By virtue of the ferromagnetic plate 6 and the ferromagnetic pot 5, the printed circuit board coil force is reinforced, the magnetic field of the printed circuit board coil 4 guided in a targeted manner, and an optimized electromagnetic compatibility provided for the adjacent modules.

If a thermal overload of the load monitored by way of the overload relay is now detected as a result of an analysis of the supply phase on the part of a monitoring device of the thermal overload relay, the supply phase monitored by way of the overload relay must be opened in order to disable the electrically conductive connection to the load. The mechanical switching unit must be actuated for this purpose. The evaluation unit 9 consequently activates the printed circuit board coil 4 such that the total force Ftot acting on the plunger 1 is varied.

For this purpose the evaluation unit 9 simply has to send a current pulse by way of the printed circuit board coil 4. The current flowing in the windings of the individual layers 41,42, 43,44 of the printed circuit board coil 4 causes a magnetic field (printed circuit board coil force) to be generated which reduces/attenuates the magnetic force F2 of the permanent magnet 3 acting on the plunger 1. The holding force F2 acting on the plunger 1 is minimized by this in such a way that the spring force F1 is embodied greater than the holding force F2. The total force Ftot acting on the plunger accordingly changes direction, such that the movably mounted plunger 1 moves in the direction of the first stop position.

By way of a corresponding arrangement of the plunger 1, the pot 5, the printed circuit board coil 4 and the plate 6 it is furthermore possible for the printed circuit board coil 4 to exert a printed circuit board coil force on the plunger 1 in the direction of the first stop position. By activating the printed circuit board coil 4 it must in any event be ensured that the total force Ftot acting on the plunger 1 is modified such that it is aligned in the direction of the first stop position. As the distance of the plunger 1 from the permanent magnet 3 increases, the holding force F2 of the permanent magnet 3 acting on the plunger 1 decreases, such that the actuating element of the mechanical switching unit can be triggered by the plunger 1, in particular by means of the spring force F1 acting on the plunger 1. The supply phase is thereupon interrupted.

Figure 2:
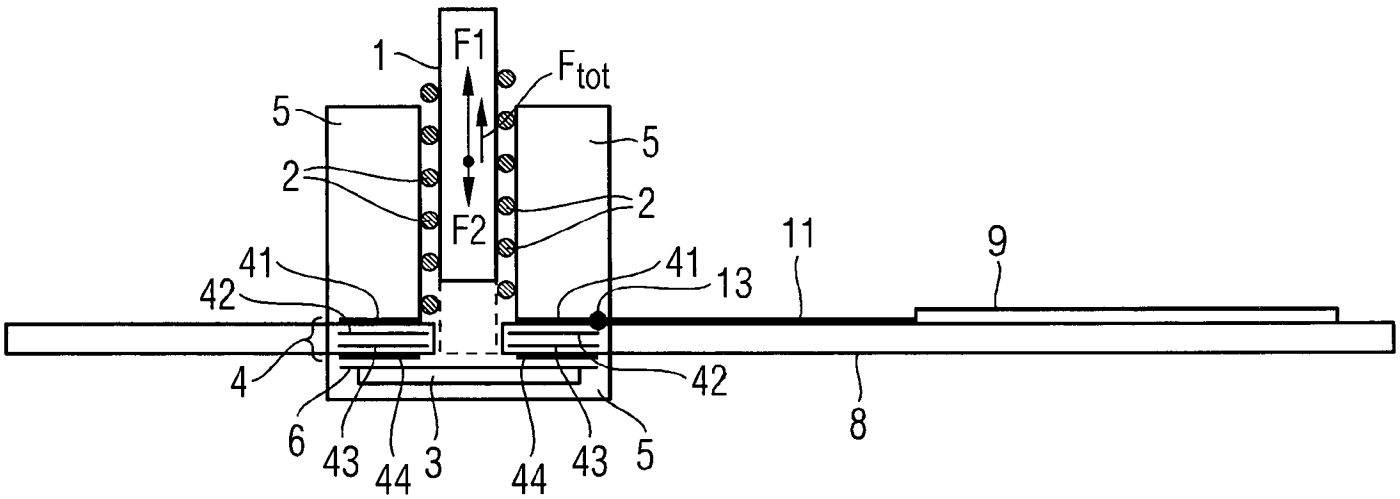
FIG. 2 shows a schematic representation of the triggering unit depicted in FIG. 1 in the triggered state.

FIG. 2 shows a schematic representation of the triggering unit depicted in FIG. 1 in the triggered state. It can be seen that the plunger 1 projects further out of the pot 5 in the triggered state of the triggering unit than in the normal state of the triggering unit. The plunger 1 is now located in the first stop position. The second stop position of the plunger 1 is indicated by the dashed line. It is evident that the plunger 1 is at a greater distance from the permanent magnet 3 than in the normal state of the triggering unit. The spring force F1 acting on the plunger 1 is greater in the triggered state than the holding force F2 acting on the plunger 1, such that the total force $F_{tot}$ acting on the plunger 1 is aligned in the same direction as the spring force F1. The plunger is in a self-holding state. No printed circuit board coil force is necessary in this state.

Without taking the printed circuit board coil force into account, the total force Ftot acting on the plunger is made up as follows: $F_{tot}$=F1+F2.

Owing to the change in position of the plunger 1 from the second stop position to the first stop position, a force is exerted by the plunger 1 onto the actuating element of the mechanical switching unit such that the mechanical switching unit is actuated. The supply phase routed by way of the device is thereupon interrupted by means of the mechanical switching unit.

Figure 3:
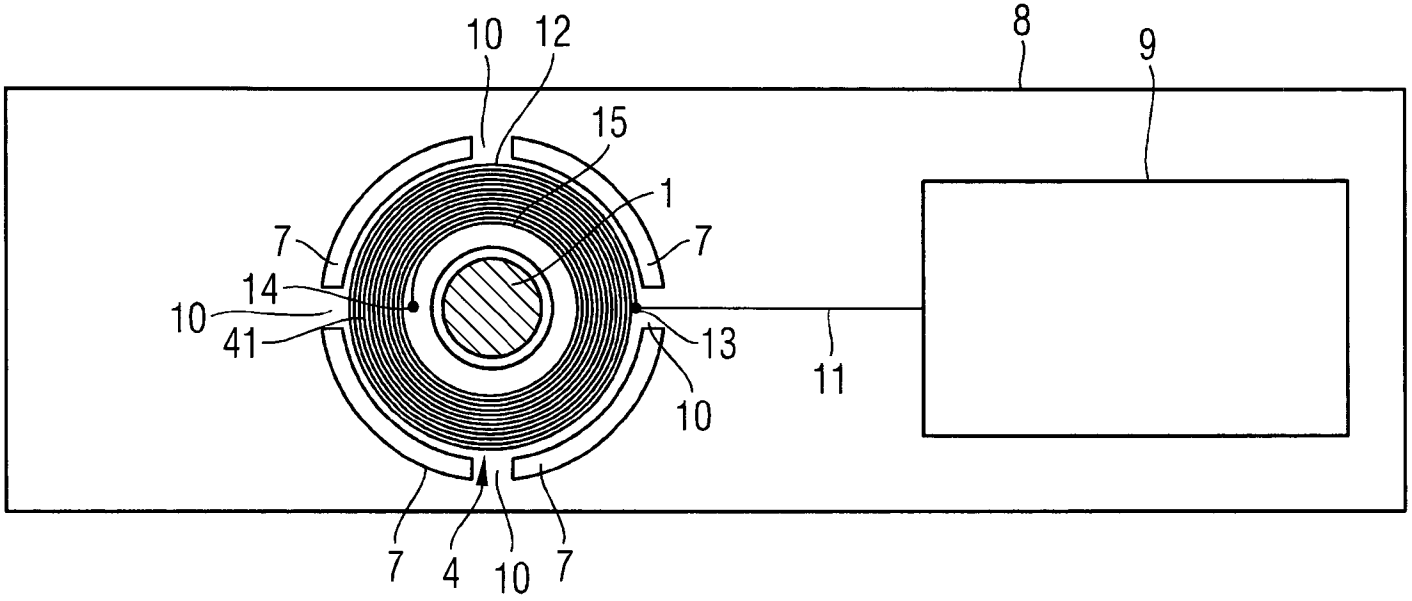
FIG. 3 shows a schematic representation of a plan view onto the printed circuit board of the triggering unit from FIGS. 1 and 2.

FIG. 3 shows a schematic representation of a plan view onto the printed circuit board 8 of the triggering unit from FIGS. 1 and 2. The triggering unit is depicted therein without pot, spring, permanent magnet and plate. Parts of the triggering unit that can be seen are the plunger 1, the printed circuit board 8, the evaluation unit 9, the connecting line 11, the printed circuit board coil 4, and apertures 7 and ribs 10 of the printed circuit board 8.

It is apparent that the evaluation unit 9 is connected by means of the connecting line 11 to a termination point 13 of the printed circuit board coil 4. Said termination point 13 establishes an electrically conductive connection to the outer winding 12 of the layer 41 of the printed circuit board coil 4 arranged on the top side of the printed circuit board 8. The layer 41 of windings of the printed circuit board coil 4 has a contact point 14 on its innermost winding 15. The electrically conductive contacting with the underlying layer of the windings of the printed circuit board coil 4 is realized by way of the contact point 14. Contacting with the evaluation unit 9 is likewise accomplished by way of a termination point of the layer of windings arranged on the underside of the printed circuit board 8, such that a closed circuit is present.

The individual windings of the layers of the printed circuit board coil 4 are embodied in an equivalent manner to the depicted layer 41 of windings of the printed circuit board coil. The individual windings of the layers of the printed circuit board coil are in particular arranged in parallel with one another. Furthermore, they are preferably arranged as congruent in the plan view, i.e. not offset laterally relative to one another. In a congruent arrangement of the windings, a straight line passing through a winding orthogonally to the printed circuit board would also intersect the corresponding winding of the winding lying thereabove or therebelow, provided the windings of the individual layers are aligned parallel to the printed circuit board.

The printed circuit board 8 has four apertures 7 and four ribs 10 adjacent to the outermost winding 12 of the top layer 41. The pot of the triggering unit is embodied in two parts and is guided with a first part through the apertures 7. The parts of the pot protruding through the apertures 7 are mechanically fixedly connected to a base of the pot (second part of the pot), such that first a plate, then the permanent magnet and finally the base of the pot are arranged between the underside of the printed circuit board. A compact design can be achieved in this way.

The printed circuit board coil 4 can be kept stable by means of the four ribs 10. In addition it is ensured that the force exerted by the spring onto the printed circuit board 8 does not result in any damage to the printed circuit board 8. The connecting line 11 is furthermore contacted with the printed circuit board coil 4 by way of a rib 10.

In comparison with conventional triggering units the triggering unit can be embodied in a more compact and cost-effective form, in particular thanks to the use of the printed circuit board coil 4. Furthermore, the triggering unit is energy-optimized, since it requires no electrical energy in the normal state and in the triggered state. The printed circuit board coil needs to be activated only in order to actuate the mechanical switching unit so that the plunger 1 can actuate the actuating element. The energy necessary for actuating the actuating element is provided by means of the spring, so only a small amount of electrical triggering energy is required in order to trigger the plunger 1.

The invention claimed is:

1. A triggering unit for actuating a mechanical switching unit of a device for interrupting a supply phase of a load, the triggering unit comprising:

a movably mounted plunger, configured to assume a first and a second stop position;

an energy accumulator;

a holding device; and a printed circuit board coil, wherein the triggering unit is configured to assume a triggered state and a normal state, wherein the plunger is situated in the first stop position in the triggered state and in the second stop position, opposite the first stop position, in the normal state, wherein in the normal state, the energy accumulator is configured to apply an energy accumulator force to the plunger in a direction of the first stop position and the holding device is configured to hold the plunger in the second stop position via a holding force, wherein the printed circuit board coil is configured to generate a printed circuit board coil force, wherein the energy accumulator, the holding device and the printed circuit board coil are embodied in such a way that in an inactive state of the printed circuit board coil, the plunger is configured to remain in the second stop position and, as a result of the printed circuit board coil being activated, the plunger is configured to assume the first stop position, such that the triggered state is present, and wherein the printed circuit board coil is embodied by way of a printed circuit board.

2. The triggering unit of claim 1, wherein in the normal state, the holding force acting on the plunger is relatively greater than the energy accumulator force acting on the plunger, resulting in the plunger remaining in the second stop position.

3. The triggering unit of claim 1, wherein in the activated state, the energy accumulator force acting on the plunger is relatively greater than the holding force acting on the plunger, resulting in the plunger remaining in the first stop position.

4. The triggering unit of claim 1, wherein the printed circuit board coil is embodied as multilayer.

5. The triggering unit of claim 1, wherein the printed circuit board coil is embodied within the printed circuit board.

6. The triggering unit of claim 1, wherein the printed circuit board of the printed circuit board coil comprises an evaluation unit for controlling the printed circuit board coil.

7. The triggering unit of claim 6, wherein if a thermal overload of the load supplied with energy by way of the device is detected, the evaluation unit is configured to activate the printed circuit board coil, thereby interrupting the supply phase to the load.

8. The triggering unit of claim 1, wherein the plunger is enclosed by a pot made of ferromagnetic material.

9. The triggering unit of claim 8, wherein the printed circuit board of the printed circuit board coil adjacent to an outermost winding of the printed circuit board coil includes at least one aperture and wherein the pot is mechanically connected to the printed circuit board by way of said at least one aperture.

10. The triggering unit of claim 9, wherein the at least one aperture frames at least 50% of an outermost winding of the printed circuit board coil.

11. The triggering unit of claim 1, wherein the holding device is arranged on a side surface of the printed circuit board coil and a plate made of ferromagnetic material is arranged between the holding device and the printed circuit board coil.

12. The triggering unit of claim 1, wherein in the normal state a part of the lateral surface of the plunger is framed by the printed circuit board coil.

13. A device for interrupting a supply phase of a load, the device comprising:

a mechanical switching unit; and the triggering unit of claim 1, wherein in the triggered state, the triggering unit is configured to actuate the mechanical switching unit, resulting in the device interrupting a supply phase of the load.

14. The device of claim 13, wherein a supply current path of a load is configured to be routed through the device via an input-side and output-side terminal of the device, wherein in the normal state of the triggering unit, the input-side terminal is connected in an electrically conductive manner to the output-side terminal and wherein in the triggered state of the triggering unit, the electrically conductive connection between the input-side terminal and the output-side terminal is interrupted.

15. The triggering unit of claim 1, wherein the energy accumulator is a spring.

16. The triggering unit of claim 1, wherein the holding device is a permanent magnet.

17. The triggering unit of claim 2, wherein in the activated state, the energy accumulator force acting on the plunger is relatively greater than the holding force acting on the plunger, resulting in the plunger remaining in the first stop position.

18. A device for interrupting a supply phase of a load, the device comprising:

a mechanical switching unit; and the triggering unit of claim 2, wherein in the triggered state, the triggering unit is configured to actuate the mechanical switching unit, resulting in the device interrupting a supply phase of the load.

19. A device for interrupting a supply phase of a load, the device comprising:

a mechanical switching unit; and the triggering unit of claim 3, wherein in the triggered state, the triggering unit is configured to actuate the mechanical switching unit, resulting in the device interrupting a supply phase of the load.

* * * * *